United States Patent [19]

Jeffress et al.

[11] Patent Number: 4,516,011

[45] Date of Patent: May 7, 1985

[54] PORTABLE ELECTRIC APPLIANCE FOR STEAMING HAIR ROLLERS PRIOR TO USE

[75] Inventors: Ronald E. Jeffress, Monroe; David J. Wanat, Meriden; Charles Z. Krasznai, Trumbull, all of Conn.

[73] Assignee: Black & Decker, Inc., Newark, Del.

[21] Appl. No.: 511,834

[22] Filed: Jul. 8, 1983

[51] Int. Cl.[3] ..... A45D 4/12; H05B 3/02; F22B 1/28

[52] U.S. Cl. ..... 219/222; 34/90; 132/9; 132/33 R; 132/33 F; 219/242; 219/273; 219/362; 219/401

[58] Field of Search ..... 219/222–226, 219/242, 271–276, 362, 401; 132/33 R, 33 G, 7, 9, 11 R, 38–40, 37 R, 37 A; 34/90, 91

[56] References Cited

U.S. PATENT DOCUMENTS

| | | | |
|---|---|---|---|
| 1,982,904 | 12/1934 | Davis et al. | 219/273 X |
| 2,062,613 | 12/1936 | Schleimer | 219/222 |
| 2,379,034 | 6/1945 | Pargman | 219/275 X |
| 3,415,255 | 12/1968 | Mitsumoto | 132/39 |
| 3,493,722 | 2/1970 | Popiel | 219/222 |
| 3,495,583 | 2/1970 | Katzman et al. | 219/222 |
| 3,612,069 | 10/1971 | Waters et al. | 219/222 |
| 3,614,381 | 10/1971 | Popeil | 219/222 |
| 3,646,316 | 2/1972 | Volosin et al. | 219/222 |
| 3,654,428 | 4/1972 | Talge et al. | 219/222 X |
| 3,666,915 | 5/1972 | DeNapoli | 219/222 |
| 3,700,853 | 10/1972 | Jensen et al. | 132/33 X |
| 3,739,787 | 6/1973 | Keldmann et al. | 132/9 |
| 3,739,788 | 6/1973 | Keldmann | 132/33 R |
| 3,749,106 | 7/1973 | Kelmann et al. | 132/33 |
| 3,754,116 | 8/1973 | Godel | 219/222 |
| 3,759,271 | 9/1973 | Caruso | 132/33 G |
| 3,762,424 | 10/1973 | Chen | 132/33 R |
| 3,781,519 | 12/1973 | Martin et al. | 219/273 |
| 3,858,029 | 12/1974 | Walter | 219/222 |
| 3,888,266 | 6/1975 | Weldon et al. | 132/39 |
| 4,298,787 | 11/1981 | Barradas | 219/401 X |

*Primary Examiner*—A. Bartis

*Attorney, Agent, or Firm*—Paul J. Lerner

[57] ABSTRACT

A portable electric appliance steaming hair rollers prior to use includes a closed box-shaped housing removably holding a plurality of foam covered steam absorbent hair rollers. A manually actuated pump is provided in the housing for transferring a measured charge of water from a water reservoir removable from the housing for filling to an electrically heated steam boiler located in the housing and communicating with a cup-shaped roller support designed to support a single roller for steaming. The support is provided with an orifice receiving steam from the boiler through a predetermined path to soak or saturate a supported roller with steam to prepare the roller for use. A flexible membrane type valve is located below the orifice between the support and the boiler for permitting steam only to flow to the roller from the boiler and preventing flooding of the boiler should water be mistakenly dumped into the cup-shaped roller support. The reservoir has a one-way valve in its base which is actuated when the water filled reservoir placed into the housing to connect water flow through the pump to the boiler.

7 Claims, 3 Drawing Figures

PORTABLE ELECTRIC APPLIANCE FOR STEAMING HAIR ROLLERS PRIOR TO USE

BACKGROUND OF THE INVENTION

1. Field of the Invention

The invention relates to a combination vapor hair setter of particularly arranged components in a closed box-shaped housing with a plurality of hair rollers supported therein and removable water reservoir carried in the housing which may be filled at the sink and replaced in the housing. A heated boiler is connected to generate steam received from the reservoir. A cup-shaped support carries a single roller, preferably foam covered, to soak with steam rising from the boiler to prepare the roller for use. To avoid back splashing by misuse of the reservoir being poured directly into the roller support, a one-way flexible flow restrictor is provided between the roller support and the boiler to permit water flow into the boiler and allow steam only flow out of the boiler to the roller.

2. Description of the Prior Art

It is known to provide hair setters of an enclosing box-shaped housing in which a multiplicity of rollers, such as toothed hard plastic or soft foam-covered, are supported for various sized curls. Generally, foam rollers are used individually and are placed in a suitable support within the box to be saturated with steam when they are then removed and used in the hair. Both hard and soft roller arrangements are known in one form or another and have been used for many years. Some use a replaceable reservoir that can be filled at the sink, placed in the appliance housing, and then supply the water for steam by various internal connections. Misuse of these arrangements is possible because the removability of the reservoir means the user can dump water directly from the reservoir into the roller support where it can back splash rather than replace the reservoir in the housing so it can be measured by a controlled pump to ensure only the proper amount is received by the boiler. Also, constant pumping may flood the boiler and thus inhibit proper steam flow whereas only one measured charge or slug of water is necessary per roller. Previous systems use a continuous steam source in which control is obtained by removal of the roller from the steam path or by a mechanical shut-off of the steam flow. Because this general combination with foam roller construction requires such a short exposure to the steam flow, usually a few seconds, variations of the time of exposure to the steam flow occur easily resulting in wide variations in curling performance. The present invention achieves repeatable results by controlling the amount of steam passed through the roller by depositing specific volume of water into a boiler, converting it to steam of a fixed volume and passing it through the roller. This sequence is repeated serially until the desired number of rollers have been conditioned when placed in the hair. Most "mist" hair setters heat all the rollers at once, or in parallel, requiring a significant heat-up time. An improved hair setter avoiding these misuse possibilities is desired to prevent both flooding with poor steam flow and the back splashing of water into the housing and possibly on the user rather than steam only to the hair roller.

SUMMARY OF THE INVENTION

Briefly described, the invention is directed to a vapor hair setter with a closed box-shaped housing holding a plurality of hair rollers and having a removable water reservoir supported in the housing with separate electrically heated boiler means in the housing connected to the reservoir. Pump means is connected to transfer a measured slug or charge of water to the boiler and the boiler preferably has a single hair-roller supporting member with an orifice therethrough to receive only steam from the boiler to soak or saturate a supported foam covered roller. To prevent misuse, a particular flow restrictor is disposed between the boiler and roller support permitting steam only flow out of the boiler to the roller to prevent flooding the boiler and back splashing of excess water in the roller support. Thus, the main object of the invention is to provide an improved vapor hair setter appliance preferably using foam-covered rollers singly in a cup support over the boiler with a pie-shaped two-direction flow restrictor supported in the cup below a drip orifice therein whereby the boiler is less likely to be flooded or, if flooded, permits only steam flow from the boiler to the supported roller.

DESCRIPTION OF THE PREFERRED EMBODIMENT

Figure 1:
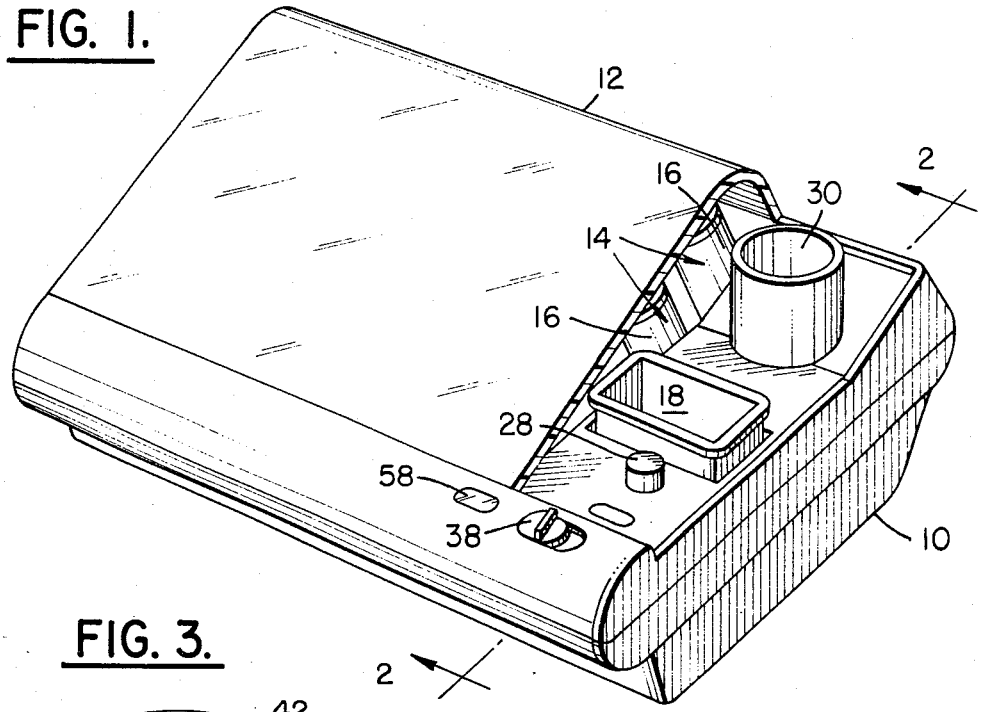
FIG. 1 is a perspective with the cover broken to show the general arrangement of the components in the vapor hair setter.
Figure 2:
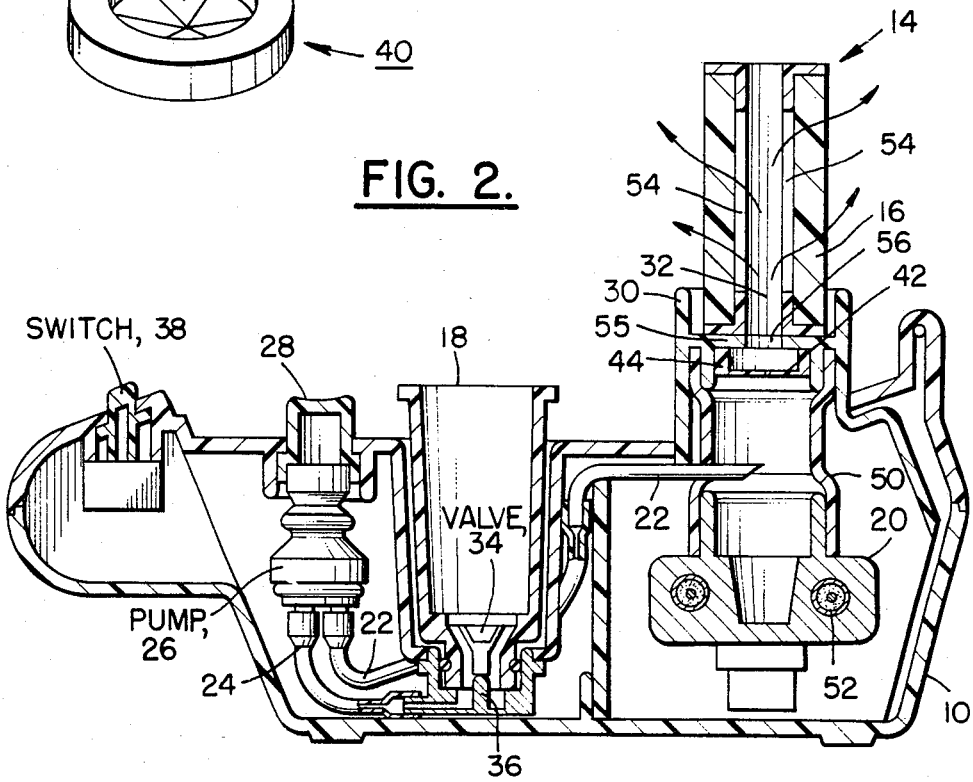
FIG. 2 is a cross-section on line 2—2 of FIG. 1 showing the arrangement of parts preventing misuse situations.

The invention is applicable to any vapor hair setter of the box-type that contains a plurality of different-sized rollers that are heated by the generation of steam whether singly or all at one time. Referring to FIG. 1, there is shown a vapor hair setter appliance including a closed box-shaped housing 10, the housing being enclosed by a plastic transparent and hinged cover 12 and supporting a plurality of different-sized hair rollers 14 in a known manner. Usually, steam may be generated by any means within the space under the cover to saturate or heat the rollers by use of a boiler and water supply. Generally, in the prior art this is done by a continuous steam source in which control is obtained by removal of the roller from the steam path or by mechanical shut-off of the steam flow. Because foam roller construction requires such a short exposure to steam flow, usually a few seconds, variations in the time of exposure to the steam flow occur easily and result in wide variations in curling performance. To permit the use of single measured slug or charge of water necessary for one roller only, rollers 14 are preferably hollow with longitudinal slots 54, as in FIG. 2 so that steam flows axially and centrally thereof and through a foam cover 16 which becomes saturated with steam to become heated. With this combination hair setter, in order to supply water, a removable water reservoir 18 in the form of a hollow rectangular cup is provided to nest and be supported in the housing 10 by any suitable means as shown in FIGS. 1 and 2. Disposed in the housing is a separate electrically heated boiler means that may be a cast-in coil 52 heating in a metallic or aluminum base 20 also supported in the housing. In order to generate steam from the water reservoir 18, suitable outlet tube 22 and inlet tube 24 are connected to a diaphragm pump 26 that is actuated by button 28 whereby a measured amount or slug of water is withdrawn from reservoir 18 by a single depression of button 28 to draw water into the pump through tube 24 and then expel it through tube 22 as a controlled amount into boiler 20 to saturate one roller. Of course, the controlled amount of water determines the steam generated in the boiler. As the measured amount enters the boiler it flashes into steam which passes upwards through the hollow core of roller 14 and foam cover 16 to heat the roller as seen in FIG. 2. For supporting a single roller, a supporting member 30 is provided in the form of a shaped cup supported by the housing directly above the boiler to form a steaming station for an individual hollow roller 14. The supporting member 30 has a roller locating hollow stud 32 with a horizontal base 55 to ensure that all rollers will be centrally disposed directly above the orifice 56 to locate the individual rollers centrally of the predetermined steam path. A sleeve 50 connects boiler 20 and supporting member 30.

Because the water reservoir 18 is designed to be removable and filled at the sink, it is provided in its base with a one-way valve 34. Valve actuating means such as stud 36 is provided on the housing to open the valve as shown in FIG. 2 to connect water flow through the pump when the reservoir is disposed in the housing. When the reservoir is removed from the housing for filling, valve 34 drops by gravity to close the cup for containing water and is automatically opened and connected on placing the reservoir 18 back in the housing. Thus, the one-way valve 34 closes the cup out of the housing and reconnects the water flow when replaced. Conventional ready light 58 may be used to indicate the proper temperature has been reached and the appliance is operable.

In this combination vapor hair setter appliance, two misuses are possible. First, before the ready light 38 indicates the device is ready, the user may pump button 28 persistently and flood boiler 28 whereas a single push on the button sends a controlled measured small amount of water to be immediately flashed into steam. The persistent pumping creates a flooded boiler and can cause the water to bubble out orifice 32 to expel hot water directly out of supporting member 30. Second, if the user pours water directly from removable reservoir 18 into supporting member 30 - which should not be done - a single drop or two may get through the orifice 32 to flash into steam and back splash the rest of the water out of the cup or build up steam pressure in the boiler as water drips through. Both of these misuses are undesirable.

Figure 3:
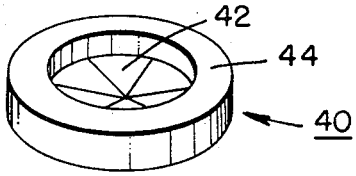
FIG. 3 is an enlarged perspective of the flow restrictor.

To avoid these misuses, there is provided a two-direction flow restrictor 40 shown in FIG. 3 that comprises a flexible multi-petal and pie-shaped diaphragm that may be molded in an annular ring 44 as part of supporting member supporting member 30 directly below the orifice 32. This flow restrictor diaphragm, with its split segments, is flexible enough to provide a retarding action on the flow rate of water in the event the boiler is flooded by repeated pumping of button 28 so water can not be forced out the supporting member - only steam can. Also, the flow restrictor allows a slow bleeding of water into the boiler if the water reservoir is dumped directly into supporting member 30. The flow restrictor is thus two-direction in flow since it allows normal steam delivery to the roller in the use condition.

Thus, the present combination permits the proper usage of the vapor hair setter when hollow rollers are used and singly supported over the boiler regardless of whether the boiler is flooded by repeated and undesired pumping by button 28 as opposed to a single measured and controlled amount of water or by the overfilling by directly pouring the reservoir 18 into the supporting member 30. It is thus possible to achieve repeatable results by controlling the amount of steam passed through the roller by depositing a specific volume of water into the boiler even if the user misuses button 28 by constant pumping or overfills of the boiler by dumping the reservoir into supporting member 30. This combination provides a single measured steam source in which control is obtained by the proper, or even improper, use of the water pump and requires no mechanical shut-off of the steam flow. This ensures that each roller needs only a short exposure to steam flow, usually a few seconds, so no variations in the time of exposure to the steam flow occur to result in wide variations in curling performance.

While we have hereinbefore shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

What is claimed is:

1. A vapor hairsetter including a closed box-shaped housing provided with an access opening having a closure, a plurality of steam absorbent hair rollers supported therein, said rollers being insertable into said housing and removable therefrom through said access opening, a removable water reservoir supported in the housing, separate electrically heated boiler means in the housing, pump means connected between reservoir and boiler for transferring a measured charge of water to the boiler from the reservoir, a hair roller supporting member in said housing, said supporting member having a steam outlet orifice therethrough connected to said boiler to receive generated steam therefrom through a predetermined path to saturate a hair roller removably positioned on the supporting member, and valve means on said roller supporting member below said orifice, between the supporting member and boiler, permitting steam only flow to said member and roller from said boiler.

2. Apparatus as described in claim 1 wherein said supporting member is a shaped cup disposed above said boiler and forming a steaming station for a single hollow roller.

3. Apparatus as described in claim 2 wherein said reservoir has a one-way water outlet valve and said housing has a valve-actuating means for automatically opening said one-way valve to allow water flow from said reservoir through said pump to said boiler upon placement of said reservoir in the housing.

4. Apparatus as described in claim 3 wherein said valve means is a flexible multi-petal and pie-shaped two-direction flow restrictor supported in a molded annular ring on said cup directly below said orifice.

5. Apparatus as described in claim 2 wherein said valve means is a flexible multi-petal and pie-shaped two-direction flow restrictor supported on said cup below said orifice.

6. Apparatus as described in claim 5 wherein said flexible multi-petal and pre-shaped two-direction flow restrictor is supported by a molded annular ring on said cup directly below said orifice.

7. A vapor hairsetter including a housing; a water reservoir removably supported in said housing; boiler means supported in said housing; pump means supported in said housing and connected to transfer a measured charge of water from said reservoir to said boiler means; a hair roller supporting member in said housing, said supporting member having a steam outlet orifice therethrough connected to said boiler means to receive generated steam therefrom through a predetermined path to saturate a hair roller removably positioned on said supporting member; and valve means in said predetermined steam path between said boiler means and said steam outlet orifice in said supporting member, said valve means permitting steam only to flow from said boiler means to said support member and roller.

* * * * *